US005146852A

United States Patent [19]

Jackson et al.

[11] Patent Number: 5,146,852

[45] Date of Patent: Sep. 15, 1992

[54] INKING DEVICE FOR POSTAGE METERS

[75] Inventors: Jerome E. Jackson, Newtown; Charles F. Murphy, III, Fairfield, both of Conn.

[73] Assignee: Pitney Bowes Inc., Stamford, Conn.

[21] Appl. No.: 777,052

[22] Filed: Oct. 16, 1991

[51] Int. Cl.[5] ..... B41F 31/24

[52] U.S. Cl. ..... 101/335; 101/333; 118/264; 118/270

[58] Field of Search ..... 101/335-343, 101/333, 104, 105, 108; 118/264-270; 156/442, DIG. 50; 222/187, 424

[56] References Cited

U.S. PATENT DOCUMENTS

| | | | |
|---|---|---|---|
| 2,619,653 | 12/1952 | Young | 118/270 |
| 4,419,931 | 12/1983 | Siegal | 101/333 |
| 4,699,054 | 10/1987 | Scrudato et al. | 101/335 |
| 4,945,831 | 8/1990 | Buan et al. | 101/349 |

*Primary Examiner*—Edgar S. Burr
*Assistant Examiner*—Lynn D. Hendrickson
*Attorney, Agent, or Firm*—Charles G. Parks, Jr.; Melvin J. Scolnick

[57] ABSTRACT

An inking device for a postage meter in a high speed mailing machine is disclosed in which the inking device has an ink reservoir containing an ink pad, and a cover member to secure the ink pad in the reservoir. The reservoir is formed as a generally rectangular tray having a flat bottom wall and upstanding front, rear and side walls, and includes a plurality of elongate upstanding ribs covering most of the area of the bottom wall for supporting an ink pad and for defining ink flow channels between the ribs. There are also relatively short upstanding ribs disposed around the other sides of the tray, and all of the ribs have upwardly inclined portions adjacent the front, rear and side walls against which a cover member presses to compress that portion of the ink pad which overlies the inclined portions of the ribs. The inclined portions also include raised protrusions thereon to increase the compression of the ink pad for a more effective seal and also to prevent the edge portions of the ink pad from creeping down the inclined portions of the ribs during continuous operation of the mailing machine.

5 Claims, 4 Drawing Sheets

INKING DEVICE FOR POSTAGE METERS

BACKGROUND OF THE INVENTION

The present invention relates generally to a high speed mailing machine which includes a postage meter for applying a postage indicia to mail pieces passing through the mailing machine. More particularly, the present invention relates to an improved inking device in the postage meter for continuously applying ink to the printing plate of the meter.

In a typical high speed mailing machine, mail pieces in the form of envelopes are fed seriatim along a feed deck by suitable feeding devices past a plurality of working stations which usually include an envelope flap opening device, a flap moistening device, a flap closing and sealing device, a postage meter, and a stacking device. The mailing machine may also include a scale for weighing the mail pieces before they pass through the postage meter. A principal advantage of such machines is that they can perform the aforementioned operations on mail pieces at a very high rate of speed, in the order of three to four mail pieces per second, and therefore are very attractive to high volume mailers such as credit institutions, telephone companies, telemarketing operations, etc.

One of the major problems in maintaining a high speed mailing machine operational is to prevent the leakage of ink from the printing device of the postage meter. Typical postage meter ink is a relatively free flowing liquid which can ooze through very minute openings if the device normally containing the ink does not maintain adequate seals to prevent such leakage. Also, typical postage meter ink has rather caustic properties and can cause considerable damage to surrounding parts of the machine if it should leak from the printing device and contact other parts of the machine. Still further, any mailing machine in which ink leaks and contacts parts of the postage meter which in turn contact the mail pieces and thereby transfer unwanted ink to the mail pieces would be commercially unacceptable and not a viable product. And since mailing machines of the type in which the present invention is found are expected to operate for hundreds of thousands of cycles without the necessity for major service, it becomes absolutely critical to the success of such a machine that the postage meter ink be completely contained except for that which is applied to the printing die of the postage meter during normal operation of the mailing machine.

In the development of the printing device for the high speed mailing machine, two significant problems dealing with leakage of ink were encountered and had to be overcome. One was the manner in which the inking device was constructed in order to maintain an effective seal between an ink pad formed of an absorbent material and an ink reservoir device which contained the ink pad. In the type of printer used in the postage meter, a large flat area of the ink pad had to be exposed to contact the exposed face of a printing die, and the problem that was confronted was how to prevent ink from escaping around the outer edge of the ink pad and flowing over parts of the inking device and thereby causing the problems mentioned above.

An early form of inking device that was incorporated in the mailing machine during early development stages is shown in the U.S. Pat. No. 5,056,433 issued Oct. 15, 1991, in which a generally rectangular ink pad is contained in a flat, also generally rectangular tray and is secured therein by a cover member having an aperture through which a substantial portion of the upper surface of the ink pad is exposed to contact the printing die, and which presses against a peripheral flange portion of the ink pad to secure it in the tray. The bottom surface of the tray is provided with elongate ribs to provide flow channels for the ink so that it can reach and saturate all portions of the ink pad to maintain and even distribution of ink therein and transfer a uniform amount of ink over the surafce of the printing die. This is critical in order to meet the requirements of the U.S. Postal Service regarding the quality of indicia printed by postage meters. The ends of the ribs were provided with ramp portions which slanted upwardly toward the outer side walls of the tray so as to urge the adjacent portions or the ink pad against the underside of the cover member to provide a seal to prevent ink from leaking between the upper surafce of the ink pad the the lower surafce of the cover. Additional short ribs having upwardly slanting upper surfaces were also provided along the end edges of the tray to provide the same function along the ends of the ink pad.

After long periods of test operation, it was found that, although the inking device shown in said prior application performed very well from the standpoint of maintaining a continuous and proper amount of ink to the ink pad for normal operation of the mailing machine, it was very susceptible to leakage problems caused by several factors, and that over an extended period of operation, very substantial amounts of ink would leak from the space between the upper surface of the flange portion of the ink pad the lower surface of the cover member intended to confine the pad in the ink tray. It was found that the reason for the leakage was that the edge portions of the ink pad, that is the peripheral flange portion on all sides of the ink pad, were sliding down the upwardly slanting ramp portions of the ribs formed in the bottom of the ink tray, thereby defeating the effect of these slanted portions which were intended to maintain the flange portions of the ink pad in firm contact with the underside of the lid to provide an effective ink seal. One reason why the leakage of ink was so great is that the ink is pumped into the reservoir under pressure to assure a constant flow of ink along the channels formed by the ribs in the tray; without an effective seal between the ink pad and the cover member, the ink is more inclined to flow out of the tray rather than along the channels, since it will take the path of least resistance. The more the edge portions of the ink pad slid down the ramp portions of the ribs, the greater was the rate of leakage of ink during operation of the machine. Thus, it became necessary to prevent any movement of the edge portions of the ink pad down the slanted portions of the ribs during operation of the machine.

In order to understand the reasons why the edge portions of the ink pad to creep down the slanted portions of the ribs during operation of the mailing machine, it is necessary to understand the forces imposed on the ink pad during each cycle of operation. One of the limiting factors in maintaining high speed operation of such mailing machines is the speed with which the printing plate of the postage meter can be reinked after each cycle of operation. Reinking after each printing cycle is necessary in order to consistently print a sharp, uniform indicia on each envelope which will pass the rigid print quality standards of the U.S. Postal Service.

Thus, during each printing cycle the printing die of the postage meter is inked by the inking device which normally is dispose in a home position, and which is extended laterally to an operative position. In this position, the inking device is moved upwardly to press an ink pad against the underside of the printing die which applies the postage indicia to the envelopes as they are fed through the postage meter. Immediately after being pressed against against the printing die, the inking device is lowered and retracted to its home position, after which the printing operation takes place. Thus, during each cycle of operation, the inking device moves from a home position laterally of the direction of envelope movement to the operative position, then upwardly to ink the printing die, then downwardly, and finally laterally back to the home position.

When it is considered that the mailing machine with which the present invention is concerned is capable of handling three to four mail pieces per second, it becomes apparent that the foregoing cycle of operation of the inking device occurs at a very high rate of speed, with successive movements of the inking device being measured in milliseconds. A typical cycle of operation requires about 100 ms, of which only 40 ms are required for actual movement of the inking device, the other 60 ms occurring while the inking device is stationary. Thus, the movement of the inking device during each cycle of operation is characterized by extremely rapid acceleration and deceleration between successive increments of movement, which produces about three to four Gs of force on the various parts of the inking device. These forces are sufficient, over a extended period of operation, to cause the edge portions of the pad to creep down the slanted portion of the ribs, thereby resulting in the serious ink leakage problems described above.

SUMMARY OF THE INVENTION

The present invention is intended to obviate if not completely eliminate the above described problems inherent in the prior inking device to the extent that the mailing machine incorporating the present invention is a commercially viable product.

The present invention solves the foregoing problems in a very simple and highly effective manner. In its broadest aspects, the invention resides in an inking device having a generally rectangular tray with a bottom wall and upstanding front, side and rear walls. The bottom walls is provided with a plurality of spaced apart, parallel, elongate ribs which extend along a major portion of the lateral dimension of the tray and extend upwardly from the bottom wall to form channels therebetween for the flow of ink, the ribs being of a uniform height with respect to the bottom wall over a major portion of their length but having relatively short end portions which slant upwardly toward the ends of the ribs. The device includes an ink pad formed of a relatively flexible, porous, absorbent material for holding ink, the ink pad having a raised central portion covering a major portion of the area of the ink pad thereby defining a peripheral flange portion. The ink pad is dimensioned longitudinally to overlie all of the ribs formed in the bottom wall of the tray, with the peripheral flange portion of the ink pad overlying the upwardly slanting end portions of the ribs. The device also includes a generally rectangular cove member which overlies the peripheral flange portion of the ink pad for securing the ink pad in the tray, the cover member having an aperture therein through which the raised central portion of the ink pad is exposed so as to contact the printing die of the postage meter. Finally, a reverse angled ramp portion is disposed on the upwardly slanted end portions of each rib for pressing into the peripheral flange portion of the ink pad when the cover member is assembled to the tray to prevent the peripheral flange portion of the ink pad from sliding down the upwardly slanted end portions of the ribs during prolonged operation of the mailing machine, thereby maintaining the integrity of the seal between the upper surface of the peripheral flange portion of the ink pad the lower surface of the cover member.

Having briefly described the general nature of the present invention, it is a principal object thereof to provide an improved inking device for postage meters which prevents ink from leaking from the ink reservoir tray during prolonged operation of the postage meter.

It is another object of the present invention to provide an improved inking device for postage meters in which the seal between an ink pad and the cover member which retains the ink pad in the ink reservoir is maintained despite severe forces imposed by the inking device during operation of the postage meter from almost instantaneous acceleration and deceleration of the inking device and sudden impact of the ink pad with the printing die of the postage meter.

These and other objects and advantages of the present invention will become more apparent from an understanding of the following detailed description of a presently preferred embodiment of the present invention when considered in conjunction with the accompanying drawings.

DETAILED DESCRIPTION OF THE INVENTION

Figure 1:
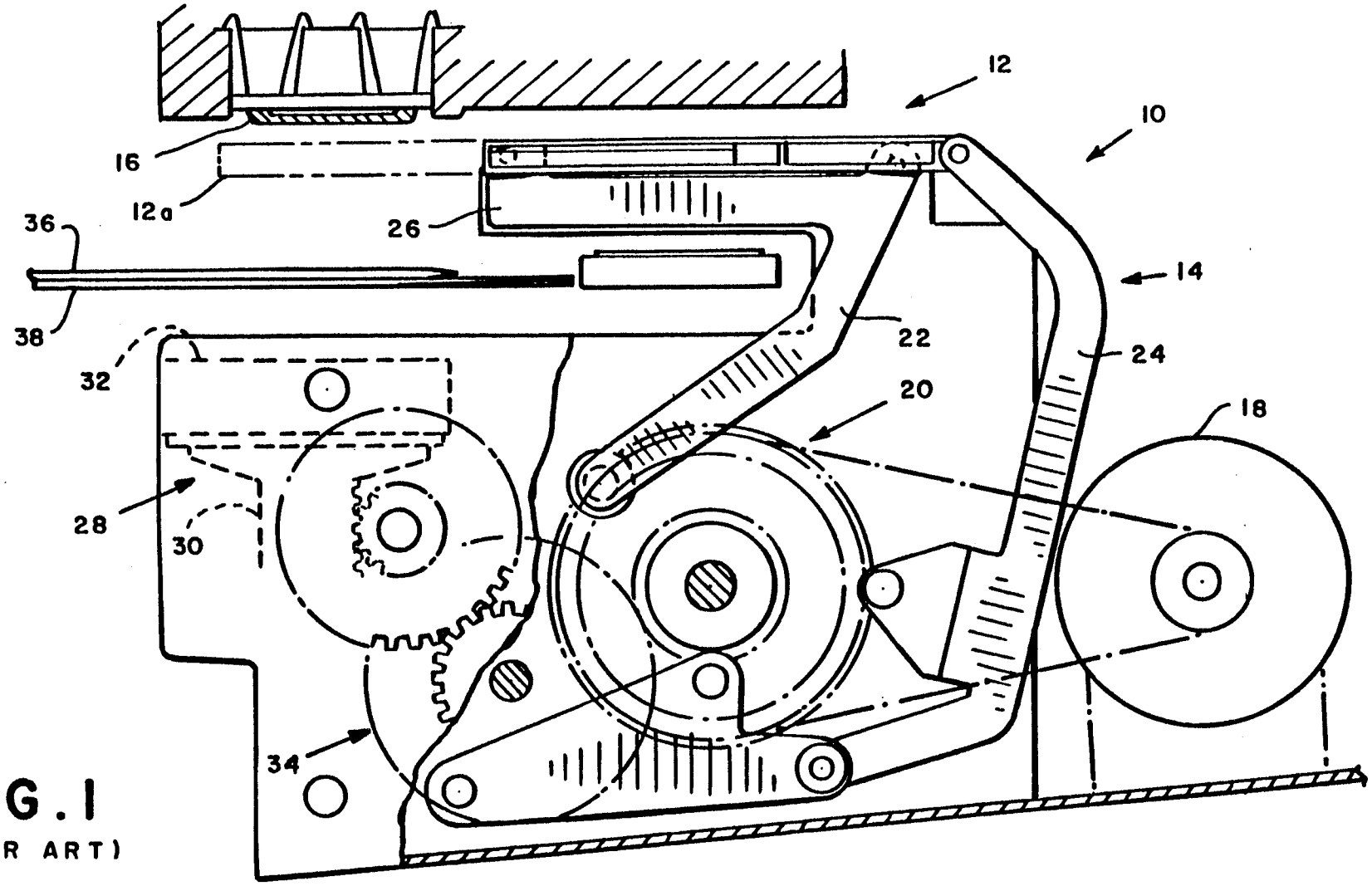
FIG. 1 (PRIOR ART)
FIG. 1 is a fragmentary view of the portion of a postage meter which controls the movement of the inking device from a home position to an operative position during each cycle of operation of the postage meter.

Referred now to the drawings, and particularly to FIG. 1 thereof, the reference numeral 10 indicates generally an apparatus for moving the inking device of a postage meter from a home position to an operative position and back during each printing cycle of the postage meter, the apparatus being shown in a somewhat fragmentary manner since it is not an essential part of the present invention. A full and complete disclosure of this apparatus will be found in U.S. Pat. No. 4,945,831, issued Aug. 7, 1990 and assigned to the assignee of this application.

For the purpose of describing the present invention, it is necessary to note only that an inking device, generally designated by the reference numeral 12, is carried by a transport mechanism generally designated 14 to move the inking device 12 from a home position shown in solid lines in FIG. 1 to an operative position represented by the dotted lines **12*a*** in which the inking device 12 directly underlies a printing die 16 of the postage meter.

The transport mechanism 14 comprises a motor 18 which drives a cam assembly generally designated 20 which in turn drives a pair of levers 22 and 24 which are connected to a suitable carrier 26 for the inking device 12. The cam assembly 20 and the levers 22 and 24 are effective to move the inking device 12 from the home position to the operative position, and then to lift the inking device 12 so that it is pressed against the underside of the printing die 16 to transfer ink from the inking device to the printing die. Immediately thereafter, the inking device is lowered back to the dotted line position 12*a* and is then retracted backwardly to the home position, thereby completing a cycle of operation of the inking device.

The apparatus 10 also includes a platen device generally designated 28 which comprises a rack 30 which supports a resilient platen 32 and is driven vertically by a suitable gear arrangement generally designed 34 which is also driven by the motor 18. The operation of the platen device is synchronized with the operation of the inking device so that the platen device raises the envelope 36 off the supporting deck 38 to press it against the underside of the printing die 16 when the inking device is in its home position.

From the foregoing description, it will be apparent that the cycle of operation of the apparatus shown in FIG. 1 is that the inking device 12 is moved from the home position forwardly to the operative position shown in dotted line, and is then raised until the upper surface of the ink pad held by the inking device is pressed against the underside of the printing die 16 to transfer ink from the ink pad to the printing die. The inking device is then lowered to the dotted line position and moved rearwardly to the home position, thereby completing its cycle of operation. Between each cycle of operation of the inking device, the envelope 36 is moved upwardly by the platen device 28 to press the envelope against the underside of the printing die 16 to transfer an image of the indicia on the printing die to the envelope, after which the platen device 28 lowers the envelope back to the feed deck 38 for transfer away from the postage meter.

Figure 2:
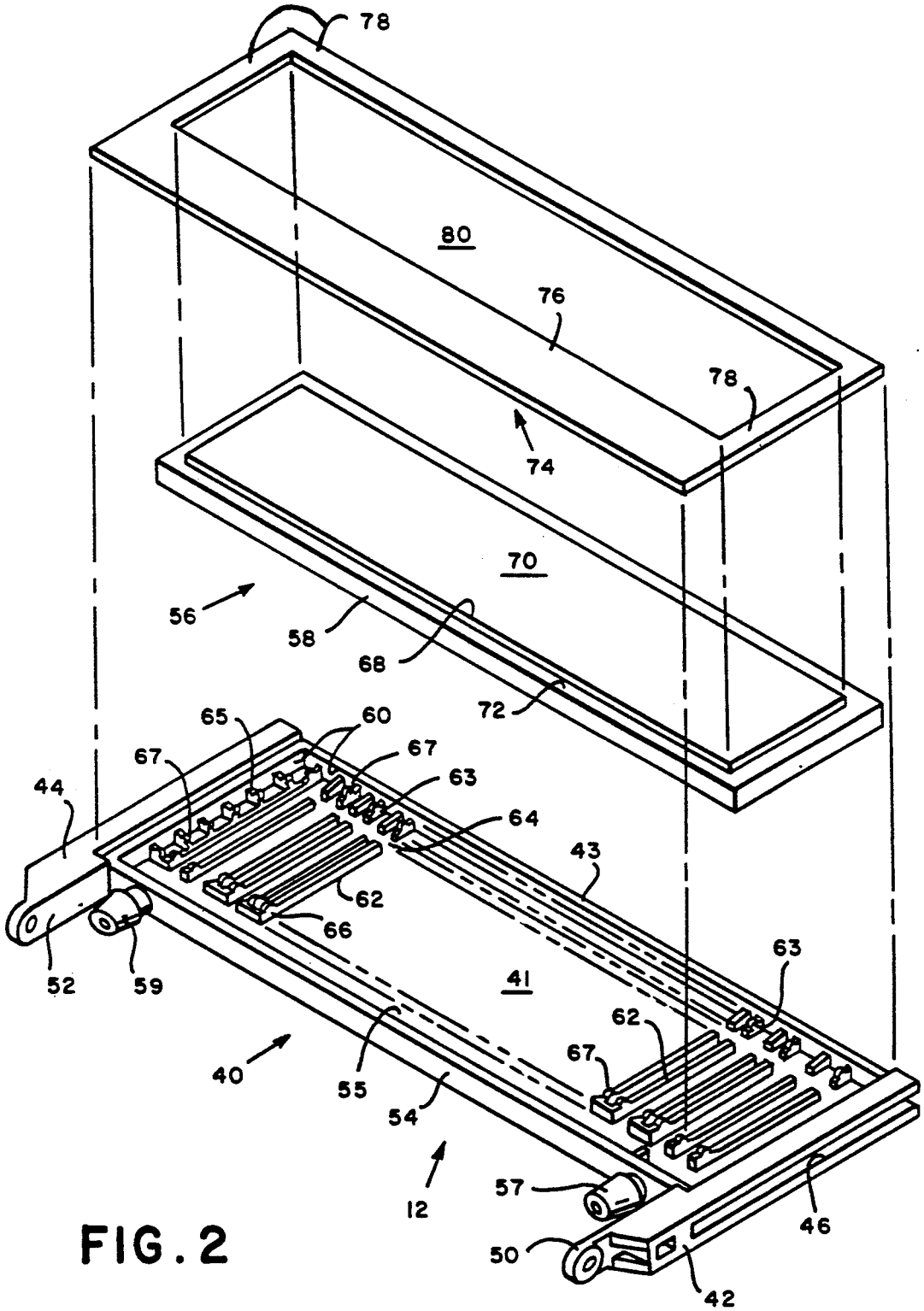
FIG. 2 is an exploded view of the major parts of the inking device of the apparatus shown in FIG. 1.

Referring now to FIG. 2, the inking device 12 is seen to comprise a generally rectangular tray 40 which forms a reservoir for ink and includes a pair of side frame members 42 and 44 which have grooves 46 and extensions 50 and 52 which together form the means by which the tray 40 is mounted on the carrier 26. The rear wall 54 of the tray 40 is provided with a pair of hollow protrusions 56 and 57 which form an inlet and an outlet respective for ink which is continuously pumped into and out of the tray 40 by a suitable pumping mechanism so that a constant supply of ink is maintained in the tray at all times. The manner in which the tray 40 is mounted on the carrier 26 and the details of the ink pumping mechanism are fully disclosed in the aforementioned U.S. patent and are not further disclosed herein since they are not necessary to an understanding of the present invention.

A rectangular ink pad generally designated by the numeral 56 is formed of a porous foam material and has a main body portion 58 which is dimensioned to fit snugly within the inner edges 60 of the side frame members 42 and 44 and the front wall 43 of the tray 40. The ink pad does not extend to the inner edge of the rear wall 54 so as to leave an elongate channel 55 extending from the ink inlet 59 to the outlet 57 through which the ink normally flows and contacts the adjacent edge of the ink pad 56 to be absorbed thereby. The tray 40 is also provided with a plurality of upstanding elongate ribs 62 which extend laterally from the ink channel 55 but terminate somewhat short of the front wall 43 of the tray. The purpose of these ribs is to support the ink pad 56 on the upper surfaces thereof so that ink can flow freely in the laterally extending spaces defined by the ribs 62 so as to assure that the entire ink pad is maintained properly saturated with ink. The tray 40 includes another plurality of relatively short upstanding ribs 63 which extend from a point spaced slightly from the ends of the ribs 62 to the front wall 43 of the tray. These two sets of ribs define another ink channel 64 which extends substantially the entire length of the tray 40 to further facilitate the flow of ink. The tray 40 includes still another plurality of relatively short upstanding ribs 65 along the inner edges 60 of both side frame members 44 and 46.

It should be noted that a rear end portion 66 of all of the ribs 62 are inclined upwardly toward the rear wall 54 of the tray 40, and that all of the ribs 63 along the front edge 43 as well as all of the ribs 65 along both of the side frame members 44 and 46 are also inclined upwardly toward the outer edges 60 against which these ribs terminate. The reason for this configuration will be made clear hereinafter.

The ink pad 56 also includes a raised central portion 68 which defines the inking surface 70 which contacts the printing die 16 to apply ink thereto. It will be seen that the raised central portion 68 is slightly smaller than the main body portion 58 thereby defining a peripheral flange 72 extending around the ink pad 56.

Figure 3:
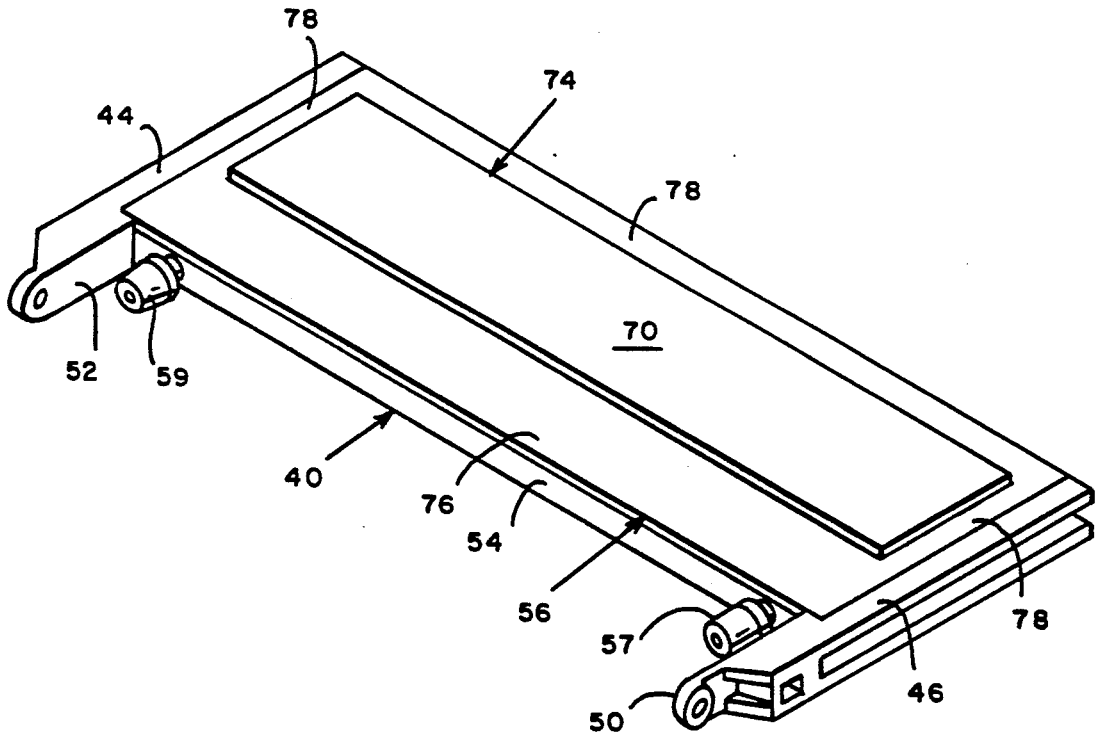
FIG. 3 is a view of the inking device parts shown in FIG. 2 in their assembled relationship.

A cover member generally designated 74 is formed as a rectangular annulus having a relatively wide rear wall 76 which is adapted to cover the ink flow channel 55 as well as the adjacent flange portion 72 of the ink pad, and narrower side and front walls 78 which are adapted to overlie the flange portions 72 which rest on the short ribs 63 and 65. The walls 76 and 78 of the cover member 74 also define a central aperture 80 through which the raised central portion 68 of the ink pad 56 protrudes to contact the printing die 16. The cover member is secured to the ink tray 40 by means of vibration welding after the ink pad is inserted therein. FIG. 3 shows the above described parts in their assembled position.

From the foregoing description, it is now possible to fully understand the problem which the present invention overcomes. As mentioned briefly hereinabove, the function of the inclined portion 66 of the ribs 62, as well as the slope of the ribs 63 and 65 is to provide sufficient compression of the flange portion 72 of the ink pad to firmly hold the ink pad in place and to provide a seal between the upper surface of the flange portion 72 of the ink pad and the undersurface of the walls 76 and 78 of the cover member. It is essential that sufficient compression of the ink pad at this location be provided to prevent ink from leaking out of the tray 40. The problem that developed with the prior ink trays was that during operation of the mailing machine over many thousands of cycles, the flange portion 72 of the ink pad would creep down the inclines portion of the ribs with the result that the compression of the flange portion 72 of the ink pad would decrease to the point that ink would leak from the tray 40 between the flange portion 72 of the ink pad and the walls of the cover member. The leakage of ink was rather severe because of the slight positive pressure at which the ink is maintained in the tray 40 during operation of the mailing machine by being continuously pumped into the tray through the inlet 59, with only sufficient ink being withdrawn from the outlet 57 to maintain the positive pressure at a fixed level. This is necessary to maintain proper saturation of the ink pad to provide a uniform print quality of the indicia.

Figure 4:
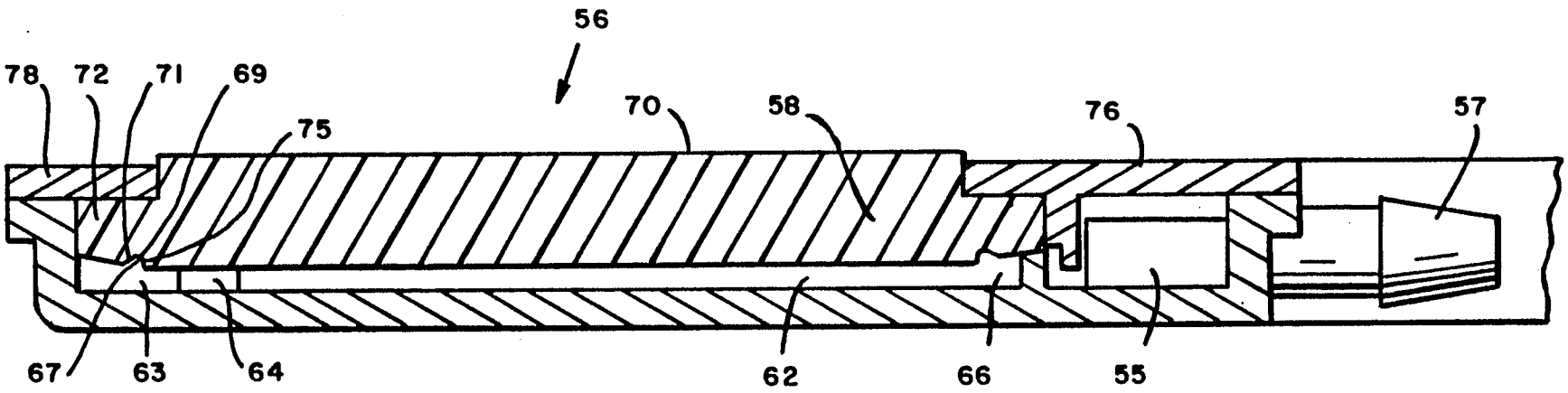
FIG. 4 is a fragmentary sectional view of the device shown in FIG. 3 along a transverse plane, showing the reverse ramps of the present invention.

The problem was overcome by providing the ribs with a raised protrusion which counteracted the tendency of the flange portion of the ink pad to slide town the inclined portion of the ribs. As best seen in FIG. 2, all of the elongate ribs 62 as well as all of the short ribs 65 along the two side frame members 44 and 46 are provided with raised protrusions 67 and 67, respectively. Along the front wall 43 every other rib 63 is provided with a similar raised protrusion 67. As best seen in FIG. 4, each protrusion 66 and 67 is disposed adjacent to but in spaced relationship with the end of the inclined end of the rib on which it is disposed, generally being located in vertical alignment with the inner edge of the walls 76 and 78 of the cover member 74. Each protrusion 66 and 67 is formed with an inclined portion 71 which is inclined in the opposite direction from that in which the end of the rib is inclined. Thus, the inclined portion 71 is upwardly inclined toward the center of the tray 40. The inclined portion 71 terminates in an arcuate portion 69 which forms an area of merger between the inclined portion 71 and a vertical portion 75 which joins with the upper surface of the rib.

It has been found that the provision of these protrusions on the ribs as described performs two essential function. One is that they increase the extent of compression on the flange portion of the ink pad to substantially increase the sealing effect between the flange portion and the underside of the walls of the cover member to a greater extent than was obtained with ribs not having the protrusions, thereby assuring a greater degree of seal against leakage than was obtained heretofore. Also, the protrusions effectively prevent the flange portion of the ink pad from sliding down the inclined portions or the ribs during prolonged operation of the mailing machine, which prevented the aforementioned seal from being lost during operation.

It must be emphasized again, to fully appreciate the significance of this invention, that it is absolutely critical that ink not escape from the ink tray during operation of the mailing machine. If it does, it can flow onto other parts of the machine and eventually onto the mail pieces being fed through the machine. Both of these situations are unacceptable, the first from the standpoint of the need for an excessive amount of service to clean and/or replace parts of the machine, the second from the standpoint of the machine not being a commercially acceptable product if it does not meet the Postal Service requirements of producing consistently clean indicia imprints with no smudging or other ink stains on the mail pieces. The present invention effectively accomplishes both of these objectives.

What is claimed is:

1. An inking device for continuously applying ink to the printing die of a postage meter during continuous operation of the postage meter, said inking device comprising:

A. a generally rectangular tray having a flat bottom wall and upstanding peripheral front, rear and side walls, B. a plurality of spaced apart, parallel, elongate, upstanding ribs extending along a major portion of the lateral dimension of said tray and extending upwardly from said bottom wall and forming channels therebetween for the flow of ink, said ribs being of a uniform height with respect to said bottom wall over a major portion of their length, but having relatively short end portions which are inclined upwardly toward the ends of said ribs, C. an ink pad formed of a relatively flexible, porous absorbent material adapted to hold ink, said ink pad having a raised central portion covering a major portion of the area of said ink pad thereby defining a peripheral flange portion, said ink pad being dimensioned longitudinally to overlie all of said ribs, with said peripheral flange portion of said ink pad lying over said upwardly slanted end portions of said ribs, D. a generally rectangular cover member adapted to overlie said peripheral flange portion of said ink pad for securing said ink pad in said tray, said cover member having an aperture therein through which said raised portion of said ink pad extends, and E. a raised protrusion disposed on said upwardly inclined end portions of said ribs for pressing into said peripheral flange portion of said ink pad to prevent said peripheral flange portion from creeping down said upwardly slanted portions of said ribs, thereby maintaining the integrity of the seal between the upper surface of said flange portion of said ink pad and the underside of said cover member.

2. An inking device as set forth in claim 1 wherein

F. said ribs extend from said rear wall of said tray toward said front wall thereof, but terminate short of said front wall, and there is a second plurality of relatively short spaced apart, parallel, upstanding ribs extending from the free ends of said first mentioned ribs to said front wall of said tray, thereby leaving a longitudinally extending ink flow channel between the free ends of both said plurality of ribs, at least a portion of each of said second plurality of ribs being inclined upwardly towards said front wall, and G. at least some of said second plurality of ribs include a raised protrusion disposed on said upwardly inclined portion of said ribs for pressing into said peripheral flange portion of said ink pad which overlies said plurality of ribs to prevent said flange portion from creeping down said second plurality of ribs.

3. An inking device as set forth in claim 2 wherein

H. there is a still further plurality of relatively short, spaced apart, parallel, upstanding ribs disposed along each of said side walls and extending therefrom inwardly toward the first of said elongate ribs, each of said further plurality of ribs also having a portion which inclines upwardly toward said side walls, and I. said further plurality of ribs including raised protrusions disposed on said upwardly inclined portion of said ribs for pressing into said peripheral flange portion of said ink pad which overlies said further plurality of ribs to prevent said flange portion from creeping down said further plurality of ribs.

4. An inking device as set forth in claims 1, 2 or 3 wherein each of said raised protrusions is formed with an inclined portion which is inclined in a direction opposite to the direction in which the portion of the rib on which the protrusion is mounted is inclined.

5. An inking device as set forth in claim 4 wherein the inclined portion of each of said raised protrusions terminates upwardly in an arcuate portion which merges with a substantially vertical portion which joins with the upper surface of the rib on which said protrusion is disposed.

* * * * *